US009661880B2

(12) United States Patent
Waller et al.

(10) Patent No.: US 9,661,880 B2
(45) Date of Patent: May 30, 2017

(54) SPORTS GARMENT

(75) Inventors: Tom Waller, Nottingham (GB); Chris Johnson, Nottingham (GB); Rebecca Bennett, Nottingham (GB); Melanie Neal, Nottingham (GB)

(73) Assignee: SPEEDO INTERNATIONAL LIMITED, London (GB)

( * ) Notice: Subject to any disclaimer, the term of this patent is extended or adjusted under 35 U.S.C. 154(b) by 0 days.

(21) Appl. No.: 14/123,701

(22) PCT Filed: Jun. 1, 2012

(86) PCT No.: PCT/GB2012/051242

§ 371 (c)(1),
(2), (4) Date: Dec. 3, 2013

(87) PCT Pub. No.: WO2012/164300

PCT Pub. Date: Dec. 6, 2012

(65) Prior Publication Data

US 2014/0090142 A1 Apr. 3, 2014

(30) Foreign Application Priority Data

Jun. 3, 2011 (GB) ..... 1109407.5

(51) Int. Cl.

| | |
|---|---|
| ***A41D 13/00*** | (2006.01) |
| ***A41D 7/00*** | (2006.01) |
| *A41D 27/00* | (2006.01) |

(52) U.S. Cl.

CPC ..... *A41D 7/00* (2013.01); *A41D 13/0015* (2013.01); *A41D 2400/24* (2013.01)

(58) Field of Classification Search

CPC ..... A41D 13/0015; A41D 7/00; A41D 13/02; A41D 2400/38; A41D 31/02; A41D 2400/24; A41B 2400/38; A41B 9/001; A41B 9/06; D04B 1/243; D04B 1/246; D04B 21/06; D04B 21/20

USPC ..... 2/69, 242, 243.1, 67, 400, 406, 73; 602/62; 450/115, 30, 31, 66, 67, 68, 69, 450/80, 83, 94; 66/171, 176, 177

See application file for complete search history.

(56) References Cited

U.S. PATENT DOCUMENTS

| | | | | |
|---|---|---|---|---|
| 1,566,267 | A * | 12/1925 | Bee | 450/31 |
| 1,587,672 | A * | 6/1926 | Nightingale | 450/30 |
| 1,632,137 | A * | 6/1927 | Jackson | 450/32 |

(Continued)

OTHER PUBLICATIONS

International Search Report for PCT/GB2012/051242 dated Aug. 13, 2012.

(Continued)

*Primary Examiner* — Bobby Muromoto, Jr.

(74) *Attorney, Agent, or Firm* — Marvin Petry; Stites & Harbison PLLC

(57) ABSTRACT

The present invention aims to reduce form drag and provides a sports garment having a chest-covering portion (1) and an abdomen-covering portion (2) for covering the wearer's chest and abdomen respectively. The chest-covering portion includes an upper compressive zone (3) formed of a textile material having a higher modulus of elasticity than a textile material forming the abdomen-covering portion. This means that, in use, a greater compressive force is applied to the wearer's chest than the wearer's abdomen.

28 Claims, 4 Drawing Sheets

(56) References Cited

U.S. PATENT DOCUMENTS

| | | | | |
|---|---|---|---|---|
| 1,813,389 | A * | 7/1931 | Duff | 112/414 |
| 1,844,888 | A * | 2/1932 | Lorenz | 450/31 |
| 2,180,180 | A * | 11/1939 | Versoy | 450/68 |
| 2,313,811 | A * | 3/1943 | Dubner | 450/68 |
| 2,520,225 | A * | 8/1950 | Scott-Elliot | 450/67 |
| 2,536,222 | A * | 1/1951 | Reid | 450/31 |
| 2,612,642 | A * | 10/1952 | Robins | 450/30 |
| 2,700,160 | A * | 1/1955 | Scholfield | 450/31 |
| 2,712,132 | A * | 7/1955 | Scholfield | 2/67 |
| 3,756,247 | A * | 9/1973 | Hand | 450/94 |
| 3,894,542 | A * | 7/1975 | Sacristan | 450/123 |
| 4,398,538 | A * | 8/1983 | Johnson | 450/8 |
| 4,538,615 | A * | 9/1985 | Pundyk | 450/131 |
| 4,564,015 | A * | 1/1986 | Friedman | 450/31 |
| 4,698,847 | A * | 10/1987 | Yoshihara | 2/69 |
| 4,955,846 | A * | 9/1990 | Greenberg | 450/69 |
| 4,956,878 | A * | 9/1990 | Boynton | 2/67 |
| 5,033,986 | A * | 7/1991 | Feigenbaum et al. | 450/30 |
| 5,119,511 | A * | 6/1992 | Packer et al. | 2/67 |
| 5,201,074 | A * | 4/1993 | Dicker | 2/70 |
| 5,590,548 | A * | 1/1997 | Osborne | 66/177 |
| 5,678,246 | A * | 10/1997 | Cooley et al. | 2/67 |
| 5,888,118 | A * | 3/1999 | Kishi | 450/122 |
| 5,954,564 | A * | 9/1999 | Ganz | 450/99 |
| 5,996,120 | A * | 12/1999 | Balit | 2/67 |
| 6,728,973 | B1 * | 5/2004 | Webley et al. | 2/400 |
| 7,040,124 | B1 * | 5/2006 | Miller et al. | 66/202 |
| 7,081,036 | B1 * | 7/2006 | Howard et al. | 450/100 |
| 7,395,557 | B1 * | 7/2008 | Ledyard | 2/113 |
| 7,415,734 | B2 * | 8/2008 | Donnelly | 2/106 |
| 7,677,953 | B2 * | 3/2010 | Oyama et al. | 450/94 |
| 7,849,518 | B2 * | 12/2010 | Moore et al. | 2/67 |
| 7,908,674 | B2 * | 3/2011 | Jones | 2/242 |
| 8,092,273 | B2 * | 1/2012 | Shinomiya | 450/97 |
| 8,172,782 | B2 * | 5/2012 | Rock | 602/62 |
| 8,196,220 | B2 * | 6/2012 | Rance et al. | 2/67 |
| 8,286,262 | B2 * | 10/2012 | Rance et al. | 2/67 |
| 8,375,465 | B2 * | 2/2013 | Whaley | 2/67 |
| 8,397,314 | B2 * | 3/2013 | Burke | 2/408 |
| 8,574,026 | B2 * | 11/2013 | Livingstone | 450/30 |
| 8,585,458 | B2 * | 11/2013 | Armanino | 450/31 |
| D697,696 | S * | 1/2014 | Obrecht | D2/844 |
| 8,701,217 | B2 * | 4/2014 | Cassoli | 2/401 |
| 8,752,216 | B2 * | 6/2014 | Sawle et al. | 2/228 |
| 8,832,863 | B2 * | 9/2014 | Yang | 2/69 |
| 8,845,389 | B2 * | 9/2014 | Abrams | 450/155 |
| 2001/0054303 | A1 * | 12/2001 | Browder, Jr. | 66/171 |
| 2008/0256675 | A1 * | 10/2008 | Di Lorenzo | 2/67 |
| 2010/0299799 | A1 * | 12/2010 | Belluye et al. | 2/69 |
| 2011/0302686 | A1 * | 12/2011 | Chapuis | 2/69 |

OTHER PUBLICATIONS

Written Opinion by They International Searching Authority for PCT/GB2012/051242 dated Aug. 13, 2012.

* cited by examiner

SPORTS GARMENT

FIELD OF THE INVENTION

This invention relates to a sports garment i.e. a garment for wearing during sporting activity. In particular, this invention relates to a sports garment for covering the chest and abdomen of a wearer. Particular examples are described in relation to swimsuits, which is a preferred use. However, the concepts can be applied to other sports and athletic garments including, for example, water polo and triathlon wear.

BACKGROUND

It is known to wear specially designed garments during sporting activity. These garments may be designed to improve the performance, comfort or aesthetic appearance of the wearer. For example, it is known from our earlier GB2444803 to provide a swimsuit which covers the wearer's chest and abdomen, and which provides an increased compressive force at the wearer's abdomen so as to flatten the abdomen thus reducing form drag and improving core stability. GB2444803 also describes additionally providing laminated compressive polyurethane panels to flatten high points on the body e.g. breasts and buttocks to reduce form drag.

SUMMARY OF THE INVENTION

The present invention aims to reduce form drag and provides, in a first aspect, a sports garment having a chest-covering portion and an abdomen-covering portion which, in use, cover the wearer's chest and abdomen respectively, wherein the chest-covering portion includes an upper compressive zone formed of a textile material having a higher modulus of elasticity than a textile material forming the abdomen-covering portion, such that, in use, a greater compressive force is applied to the wearer's chest than the wearer's abdomen.

The compressive forces generated in the sports garment of the present invention effectively squash the wearer's chest to a greater extent than they squash the wearer's abdomen. The result is that the wearer's torso is formed into a tubular, cylindrical shape. This may have advantages in some sporting activities. For example, it is thought that this tubular/cylindrical shape should minimise form drag as the wearer moves through water in swimming activities.

Preferably, the upper compressive zone is dimensioned and positioned such that, in use, it compresses the wearer's chest. Female swimmers' breasts, in particular, form a high point on the body which can increase form drag so arranging the upper compressive zone so that it compresses the wearer's chest helps minimise this form drag.

It is preferred that the abdomen-covering portion provides minimal and more preferably substantially no compressive force to the abdomen. This allows the abdomen to remain uncompressed so that it forms the tube/cylinder in line with the compressed chest.

Preferably, the garment further comprises a lower body-covering portion which, in use, covers at least part of the wearer's thighs, hips and/or buttocks. The lower body-covering portion includes a lower compressive zone formed of a textile material having a higher modulus of elasticity than the textile material forming the abdomen-covering portion. This means that, in use, a greater compressive force is applied to at least part of the wearer's thighs, hips and/or buttocks than the wearer's abdomen.

The compressive forces generated by this embodiment of the garment of the present invention act to squash the wearer's lower body to a greater extent than the wearer's abdomen thus forming the wearer's body into a tubular shape. Accordingly, the wearer's torso and lower body are both forced into a tubular/cylindrical shape which may further reduce form drag as the wearer moves through water.

Preferably, the lower compressive zone is dimensioned and positioned such that, in use, it covers at least part of the wearer's hips, thighs and buttocks.

The modulus of elasticity of the textile material forming the chest-covering portion may be greater than, equal to or less than the modulus of elasticity of the textile material forming the lower body-covering portion. The magnitude of the compression will be relative to the compressibility of the body region to which compression is applied to achieve the desired deformation.

As discussed above, the modulus of elasticity in the compressive zone(s) is greater than the modulus of elasticity at the abdomen-covering portion. Preferably, there is a continuous or stepped increase (preferably a gradual increase) in modulus of elasticity in the compressive zone(s) from proximal the abdomen-covering portion to the area of maximum compressive effect. This allows the compressive zone(s) to force the wearer's chest and optionally the hips, buttocks and/or thighs towards the wearer's abdomen thus further assisting in the formation of a tubular/cylindrical body shape with reduced form drag in the water.

There may be a continuous or stepped decrease (preferably a gradual decrease) in the modulus of elasticity in the compressive zone(s) towards the edges of the chest-covering portion/lower body-covering portion distal from the abdomen-covering portion. For example, where the lower body-covering portion extends to cover the wearer's thighs, there is preferably a gradual stepped decrease in modulus of elasticity from the upper thigh to the lower thigh (adjacent the knee) to allow unrestricted movement of the wearer's knee.

Preferably, the textile material for forming the abdomen-covering portion and the textile material for forming the upper compressive zone and/or the textile material for forming the lower compressive zone are both/all single ply. This helps reduce the bulk/weight of the garment.

Preferably the textile material for forming the abdomen-covering portion and the textile material for forming the upper compressive zone and/or the textile material for forming the lower compressive zone comprise a single base fabric (such as an elastic stretch base fabric) having variations in the modulus of elasticity. To clarify, the upper compressive zone, lower compressive zone and abdomen-covering portion can all be formed of different textile materials (provided that they have the required relative moduli of elasticity) but, preferably, they are all formed of the same base fabric which is modified in certain areas i.e. in the compressive zones to introduce the necessary variations in the modulus of elasticity. In other words, the textile material forming the abdomen-covering portion preferably comprises the base fabric whilst the textile material(s) forming the compressive zone(s) preferably comprises modified base fabric.

The variations in the modulus of elasticity can be obtained by incorporating differing amounts and/or differing dtex/denier (linear mass density—which is related to thread thickness) of elastic threads in the base fabric. The number of threads of the elastic thread and/or the linear mass density of the elastic thread is greater at the areas of higher modulus of elasticity (compressive zone(s)) than at the abdomen-covering portion. In some embodiments the compressive zone(s) include elastic threads having an effective linear mass density at least 5 times as great as the linear mass density of the elastic threads in the base fabric. By "effective" linear mass density, we mean the actual linear mass density for a single thread, or where a number of threads are combined and then included as if they were a single, thread, we mean the combined linear mass density. For example, if two threads of 60 dtex are included effectively as a single thread, the effective near mass density is 120 dtex.

Alternatively, the variations in modulus of elasticity can be obtained by one or more of the following methods: varying the stitch types in the base fabric; using different weights of base fabric; varying the stitch densities in the base fabric; varying the patterning on the base fabric; incorporating different yarn types into the base fabric; and using different yarn endages in the base fabric.

Preferably the base fabric is a knitted fabric. More preferably, it is a warp knit fabric, for example, a warp knit fabric including both inelastic threads (such as nylon) and elastic threads (such as Lycra (RTM)). Preferably, the percentage of elastic threads (e.g. Lycra (RTM)) is around 40 wt %. Preferably, the base fabric has a weight of around 200 $gm^2$.

In the compressive zone(s), the amount of elastic threads may increase to around 60 wt %. It may increase to around 60 wt % in a gradual continuous manner or it may increase in a step-wise manner. For example, it may increase initially to around 50 wt % (e.g. 52 wt %) and finally to around 60 wt % at the area of maximum compressive effect in the compression zone(s). Preferably, the modified base fabric has a weight of around 400 $gm^2$ in the area(s) of maximum compressive effect in the compression zone(s).

Preferably, the compressive zone(s) contain elastic threads having a greater linear mass density than the elastic threads in the base fabric. For example, the elastic threads (e.g. Lycra (RTM)) used in the base fabric may have an effective linear mass density of around 120 dtex (by using two 60 dtex threads) whilst, in the compressive zone(s), additional elastic threads having a linear mass density of around 310 dtex may be incorporated. In the areas of maximum compressive effect in the compressive zone(s) yet further double threads of 310 dtex (giving an effective liner mass density of 620 dtex) are included. This gives a stepped increase in the compressive effect of the compressive zone(s).

Preferably, the number of elastic threads is greater in the compressive zone(s) than in the base fabric. Preferably, the number of elastic threads of the textile material forming the compressive zones increases in a gradual stepped fashion. As previously explained, the compressive zone(s) include additional elastic threads to those in the base fabric and yet further additional threads are included at the area(s) of maximum compressive effect in the compressive zone(s).

A fabric having a nylon/Lycra (RTM) base fabric with variations in modulus of elasticity caused by changes in the number of threads and the linear mass density of the threads is described in EP1979520.

The garment is preferably formed of a number of panels of base fabric where the panels are joined to one another by stitching or, more preferably, by bonding. Such bonded seams have been found to have a particularly low profile and resultant low drag properties in the water. They also enhance the structural and supportive benefits of the garment (i.e. they result in 'body stabilisation').

Preferably, the garment comprises at least one base fabric panel which includes at least part of the upper and/or lower compressive zones. More preferably, the garment comprises at least one base fabric panel which includes at least part of the upper and/or lower compressive zones as well as at least part of the abdomen-covering portion. Most preferably, the garment comprises at least one panel which includes at least part of both the upper and lower compressive zone and at least part of the abdomen-covering portion, the base fabric being modified at the upper and lower compressive zones to increase the modulus of elasticity in those zones.

A preferred panel is configured to extend from the chest-covering portion (including at least part of the upper compressive zone), over at least part of the abdomen-covering portion and down to the lower body-covering portion (including at least part of the lower compressive zone). Preferably, such a panel includes a part of the upper compressive zone which, in use, extends to cover (and flatten) one of the wearer's chest. Preferably, such a panel includes a part of the lower compressive zone which, in use, extends over the greater trochanter and/or buttock and/or the front of the thigh (preferably over all of these areas). Preferably, the garment includes two such panels, one for each side of the body. It may also include a third such panel for the front, centre of the body.

Having at least one panel including at least part of one or both compressive zones and preferably at least part of the abdomen-covering portion helps maintain a smooth body profile, which further reduces drag form and minimises water resistance of seams. It also facilitates manufacturing of the garment since the number of seams is reduced.

Preferably, the sports garment is a swimsuit, a triathlon suit or a wet suit and the tubular profile of the torso (and optionally the lower body) acts to decrease drag form as the wearer's body moves through the water, or possibly, air.

Preferred embodiments of the present invention will now be described with reference to the accompanying figures in which:

DETAILED DESCRIPTION OF THE INVENTION

Figure 1:
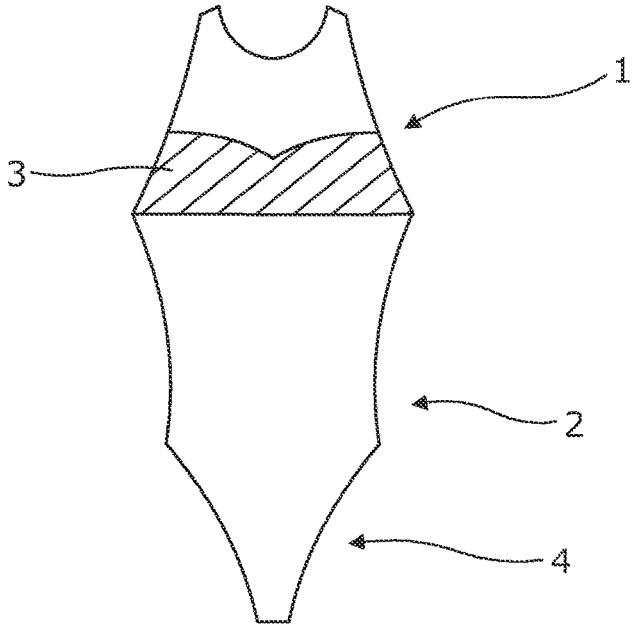
FIG. 1 is a front view of a first embodiment of the present invention.
Figure 3:
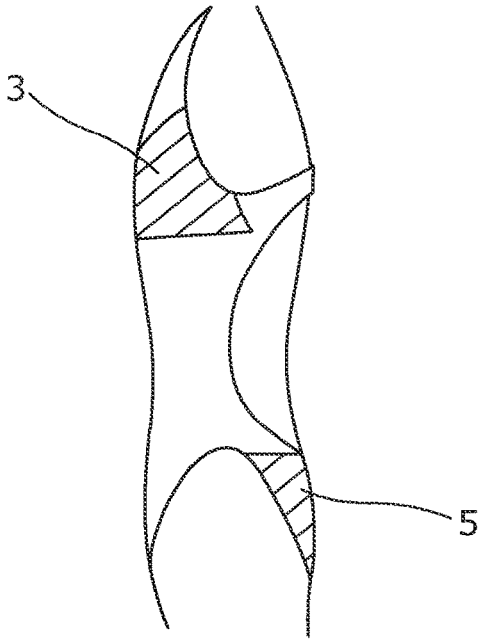
FIG. 3 is a side view of the first embodiment.

FIGS. 1 and 3 show a first embodiment of the present invention which is a racer backed swim suit. FIG. 1 shows a front view of the first embodiment whilst FIG. 3 shows a side view.

The swim suit includes a chest-covering portion 1 and an abdomen-covering portion 2. An upper compressive zone 3 is provided on the chest-covering portion in the area for covering the swimmer's chest. The swim suit also includes a lower body covering portion 4 which includes a lower compressive zone 5 (shown in FIG. 3). The lower compressive zone 5 is arranged to cover the wearer's buttocks.

Figure 2:
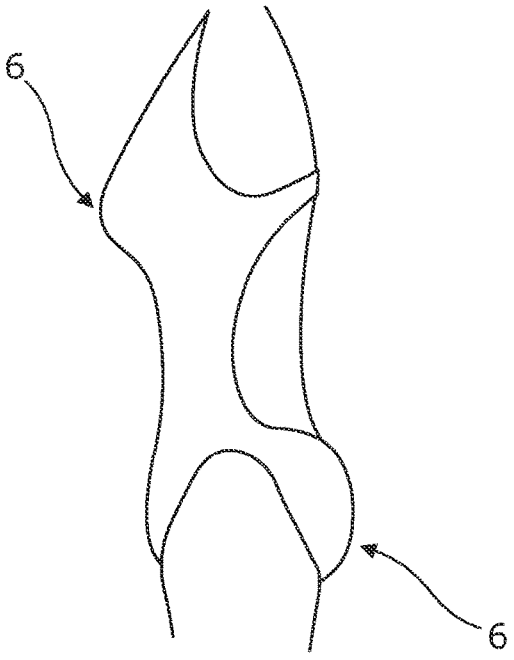
FIG. 2 is a side view of a prior art racer backed swim suit.

When a conventional racer backed swim suit is worn by a female swimmer, the chest and buttocks form high points 6 on the body (see FIG. 2), which induce form drag as the swimmer moves through the water.

The present invention aims to reduce this form drag by compressing at least the chest. FIG. 3 shows a side view of the first embodiment on a female torso. It can be seen that the high points 6 present when a conventional suit is worn (see FIG. 2) are compressed by the upper and lower compressive panels. The wearer's abdomen remains substantially uncompressed so that the wearer's body profile approximates a cylinder or tube. Such a tubular/cylindrical shape reduces drag form as the swimmer moves through the water.

Figure 4:
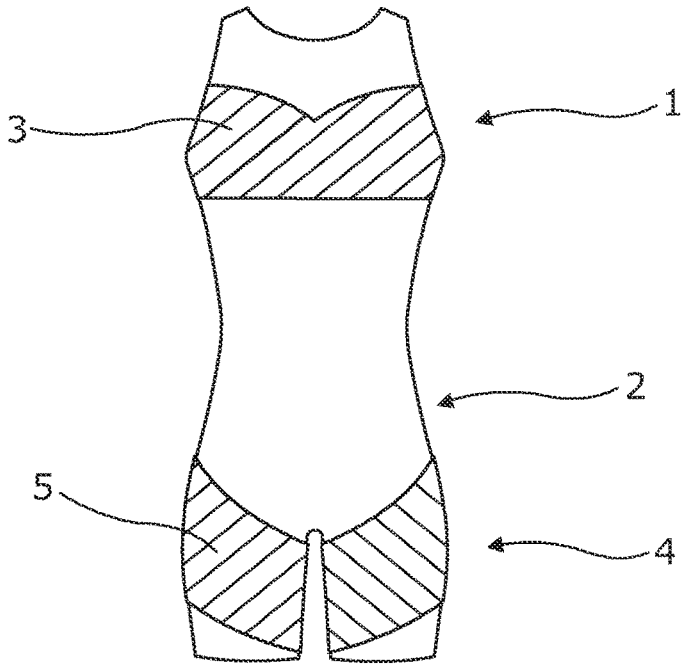
FIG. 4 is a front view of a second embodiment of the present invention.
Figure 6:
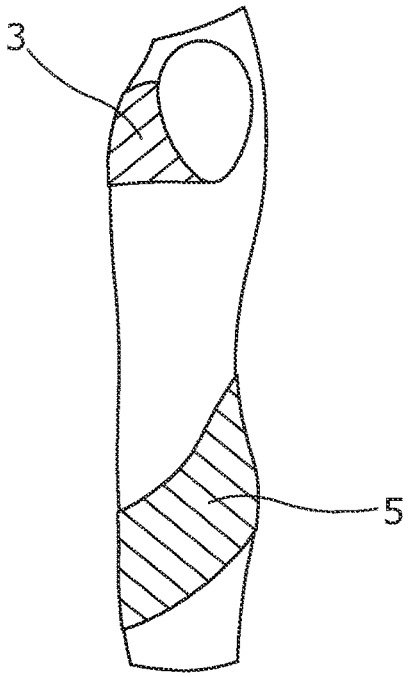
FIG. 6 is a side view of the second embodiment.

FIGS. 4 and 6 show a second embodiment of the present invention which is a knee skin swim suit. FIG. 4 shows a front view of the second embodiment whilst FIG. 6 shows a side view.

The swim suit includes a chest-covering portion 1 and an abdomen-covering portion 2. An upper compressive zone 3 is provided on the chest-covering portion in the area for covering the swimmer's chest. The swim suit also includes a lower body covering portion 4 which includes a lower compressive zone 5 (shown in FIG. 3). The lower body-covering zone extends over the wear's hip, buttocks and upper thighs. The lower compressive zone 5 is arranged to cover the wearer's buttocks, hips and the front of the thighs but it could also extend to cover the rear of the thighs.

Figure 5:
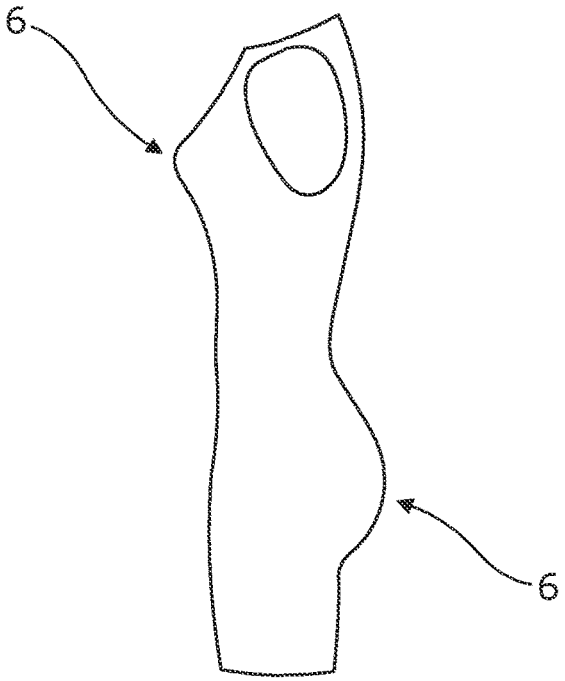
FIG. 5 is a side view of a prior art knee skin swim suit.

When a conventional knee skin swim suit is worn by a female swimmer, the chest and buttocks form high points 6 on the body (see FIG. 5) which induce form drag as the swimmer moves through the water.

The present invention aims to reduce this form drag by compressing at least the chest. FIG. 6 shows a side view of the second embodiment on a female torso. It can be seen that the high points 6 present when a conventional suit is worn (see FIG. 5) are compressed by the upper and lower compressive panels. The wearer's abdomen remains substantially uncompressed so that the wearer's body profile approximates a cylinder or tube. Such a tubular/cylindrical shape reduces drag form as the swimmer moves through the water.

Figure 7:
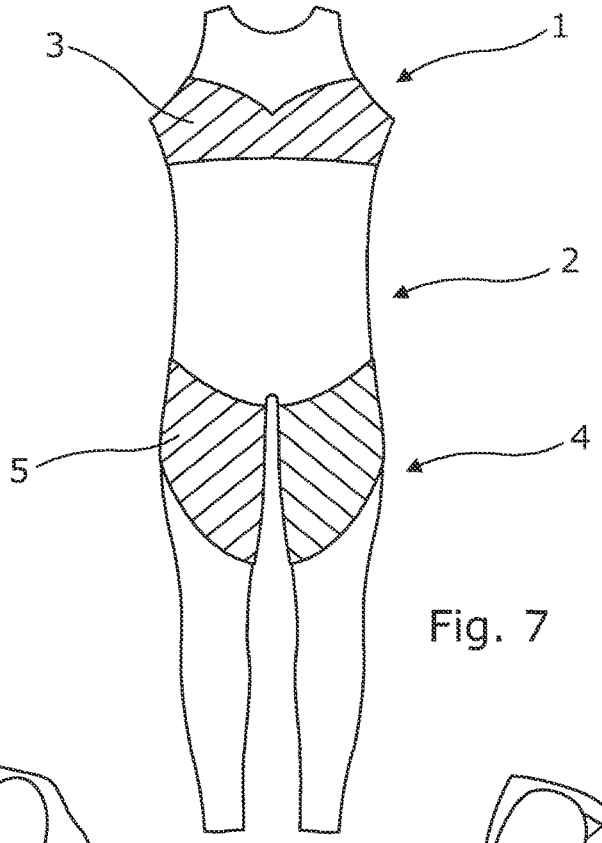
FIG. 7 is a front view of a third embodiment of the present invention.
Figure 9:
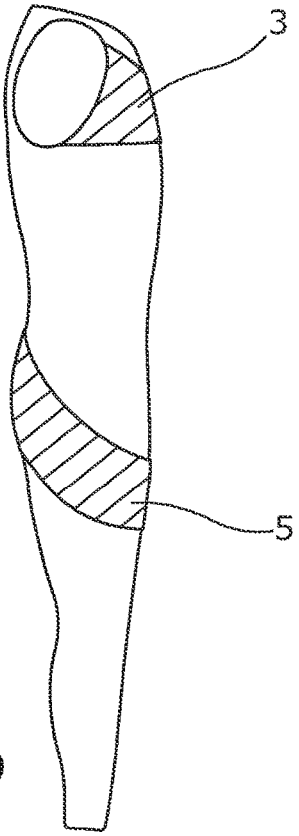
FIG. 9 is a side view of the third embodiment.

FIGS. 7 and 9 show a third embodiment of the present invention which is a full body swim suit. FIG. 7 shows a front view of the third embodiment whilst FIG. 9 shows a side view.

Figure 8:
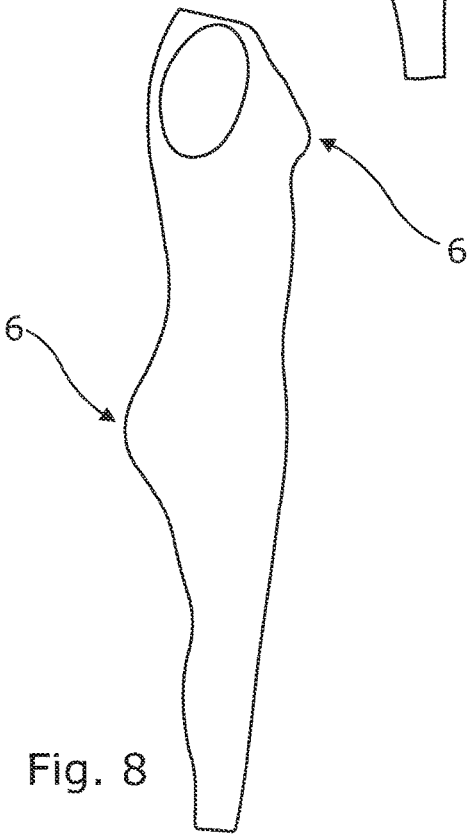
FIG. 8 is a side view of a prior art full body swim suit.

The swim suit includes a chest-covering portion 1 and an abdomen-covering portion 2. An upper compressive zone 3 is provided on the chest-covering portion in the area for covering the swimmer's chest. The swim suit also includes a lower body covering portion 4 which includes a lower compressive zone 5 (shown in FIG. 8). The lower body-covering zone extends over the wear's hips, buttocks and legs, down to the wearer's ankles. The lower compressive zone 5 is arranged to cover the wearer's buttocks, hips and the front of the thighs but it could also extend to cover the rear of the thighs.

When a conventional full body swim suit is worn by a female swimmer, in particular, the chest and buttocks form high points 6 on the body (see FIG. 8) which induce form drag as the swimmer moves through the water.

The present invention aims to reduce this form drag by compressing at least the chest. FIG. 9 shows a side view of the third embodiment on a female torso. It can be seen that the high points 6 present when a conventional suit is worn (see FIG. 8) are compressed by the upper and lower compressive panels. The wearer's abdomen remains substantially uncompressed so that the wearer's body profile approximates a cylinder or tube. Such a tubular/cylindrical shape reduces drag form as the swimmer moves through the water.

Preferably, the s suits of the first, second and third embodiment are formed of a single base fabric (such as an elastic stretch base fabric) having variations in the modulus of elasticity. To clarify, the upper compressive zone 3, lower compressive zone 5 and abdomen-covering portion 2 are all formed of the same base fabric which is modified in certain areas i.e. in the compressive zones 3, 5, to introduce the necessary variations in the modulus of elasticity.

The variations in the modulus of elasticity in the first, second and third embodiments are obtained by incorporating differing amounts and differing linear mass density of elastic threads in the base fabric. The number of threads of the elastic thread and the linear mass density of the elastic thread is greater at the areas of higher modulus of elasticity (compressive zone(s) 3, 5) than at the abdomen-covering portion 2.

The base fabric is a warp knit fabric including both inelastic threads (nylon 60 wt %) and elastic threads (Lycra (RTM) 40 wt %). The elastic threads have an effective linear mass density of 120 dtex (with double 60 dtex threads being used). This gives a textile having a weight of 200 $gm^2$. In the compressive zone(s) 3, 5, the percentage of elastic threads increases first to 52 wt % and then 60 wt % with a corresponding increase in linear mass density of the threads and in the number of threads. This is achieved by knitting additional elastic threads having a linear mass density of around 310 dtex into the base fabric in the compressive zones. In the areas of maximum compressive effect in the compressive zones yet further double threads of 310 dtex (giving an effective liner mass density of 620 dtex) are knitted into the base fabric. This gives a stepped increase in the compressive effect of the compressive zones from proximal the abdomen-covering portion to the area of maximum compressive effect. The maximum textile weight in the compressive zones 3, 5 is 400 $gm^2$.

It should be noted that any of the methods previously described for achieving the variations in modulus of elasticity can be used in any of the embodiments.

Figure 10:
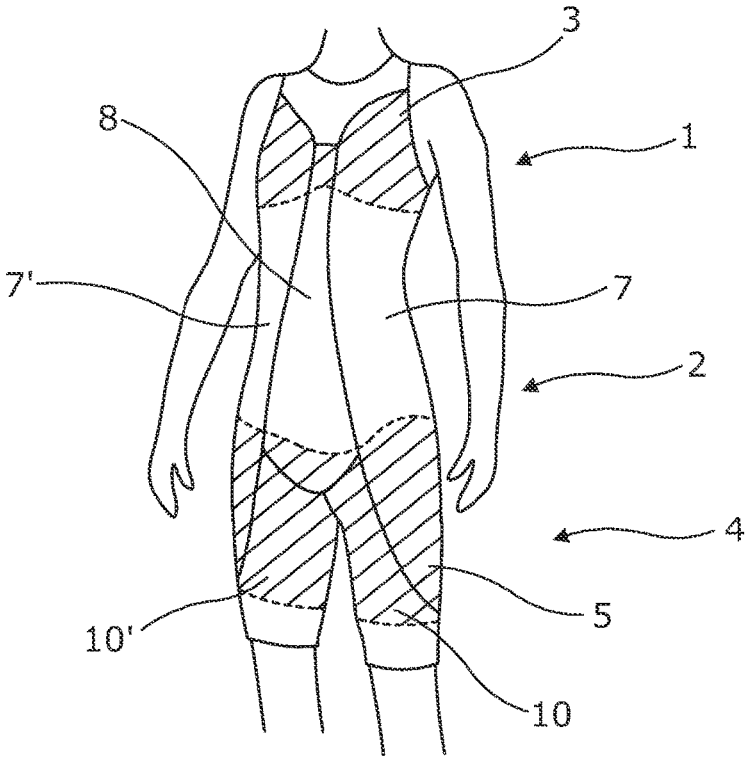
FIG. 10 is a front view of a fourth embodiment.
Figure 11:
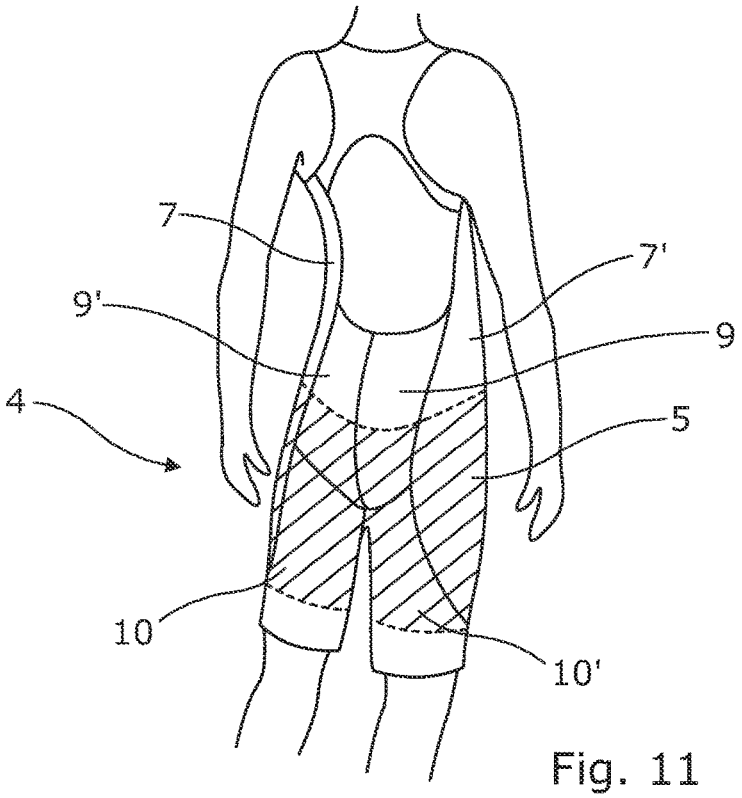
FIG. 11 is a rear view of the fourth embodiment.

FIG. 10 shows a fourth embodiment which is similar to the second but which shows the various panels of base fabric making up the suit. The panels are joined to one another by bonded seams which have been found to have a particularly low profile and resultant low drag properties in the water.

The fourth embodiment comprises a side panel 7 which includes part of both the upper and lower compressive zones 3, 5 (and part of the abdomen-covering portion), the base fabric being modified at the upper and lower compressive zones 3, 5 to increase the modulus of elasticity in those zones.

The edges of the compressive zones are defined by dotted lines in the Figures whilst solid lines denote the panel edges (seams)

The panel is configured to extend from the chest-covering portion 1 (including part of the upper compressive zone 3), over at least part of the abdomen-covering portion 2 and down to the lower body-covering portion 4 (including part of the lower compressive zone 5). The panel includes a part of the upper compressive zone 3 which, in use, extends to cover (and flatten) one side of the wearer's chest. The panel includes a part of the lower compressive zone 5 which, in use, extends over the greater trochanter and buttock and the outer side of the thigh. The garment also includes a further side panel 7' for the other side of the body.

Having a side panel 7, 7' including part of both compressive zones and at least part of the abdomen-covering portion helps maintain a smooth body profile, which further reduces drag form and minimises water resistance of seams. It also facilitates manufacturing of the garment since the number of seams is reduced.

The panels 7, 7', are joined to one another on the front side of the suit through a front panel 8 which extends from the sternum to the crotch over the front of the abdomen. This panel also includes part of both compressive zones 3, 5.

The base fabric forming the side panels 7, 7' and the front panel is modified in the compressive zones 3, 5 by increasing the number/density of elastic threads to increase the modulus of elasticity. There is a gradual increase in modulus of elasticity from the abdomen-covering portion to the area of maximum compression in the compressive zone(s).

The panels 7, 7' are joined to one another on the rear side of the suit through two rear panels 9, 9' which include part of the lower compressive zone 5. The lower compressive zone also continues in two leg panels 10, 10', which encircle the wearer's thighs and join to the lower end of the side panels 7, 7'.

Thus it can be seen that the upper compressive zone 3 extends across the two side panels 7, 7' and the front panel 8 to compress the wearer's chest. The lower compressive zone 5 extends across the two side panels 7, 7', the two rear panels 9, 9' and the two leg panels 10, 10' to compress the wearer's hips, thighs and buttocks. This squashes the wearer's body into a profile approximating a cylinder/tube which helps reduce form drag as the swimmer moves through the water.

The skilled person will appreciate that the suits illustrated in the Figures and described above are examples embodying inventive concepts described herein and that many and various modifications can be made without departing from the invention.

The invention claimed is:

1. Sports garment having a chest-covering portion and an abdomen-covering portion which, in use, cover the wearer's chest and abdomen respectively, wherein the chest-covering portion includes an upper compressive zone formed of a textile material having a higher modulus of elasticity than a textile material forming the abdomen-covering portion, such that, in use, a greater compressive force is applied to the wearer's chest than the wearer's abdomen, and wherein the textile material for forming the upper compressive zone and the textile material for forming the abdomen-covering portion comprise a single layer of the same base fabric having variations in the modulus of elasticity, the upper compressive zone having an upper edge distal from the abdomen-covering portion and a lower edge proximal the abdomen-covering portion, and wherein there is a gradual increase in modulus of elasticity in the upper compressive zone from at least on of said edges to an area of maximum compressive effect in the upper compressive zone.

2. Sports garment according to claim 1 wherein the upper compressive zone is dimensioned and positioned such that, in use, it compresses the wearer's breasts.

3. Sports garment according to claim 1 wherein the abdomen-covering portion provides substantially no compressive force to the abdomen.

4. Sports garment according to claim 1 further comprising a lower body-covering portion which, in use, covers at least part of the wearer's thighs, hips and/or buttocks wherein the lower body-covering portion includes a lower compressive zone formed of a textile material having a higher modulus of elasticity than the textile material forming the abdomen-covering portion such that, in use, a greater compressive force is applied to at least part of the wearer's thighs, hips and/or buttocks than the wearer's abdomen.

5. Sports garment according to claim 4 wherein the lower compressive zone is dimensioned and positioned such that, in use, it covers the wearer's hips, thighs and buttocks.

6. Sports garment according to claim 4 wherein the textile material for forming the lower compressive zone and the textile material for forming the abdomen-covering portion comprise the same base fabric having variations in the modulus of elasticity.

7. Sports garment according to claim 6 wherein the variations in the modulus of elasticity are obtained by incorporating varying amounts and/or densities of elastic threads in the base fabric.

8. Sports garment according to claim 6 wherein the variations in the modulus of elasticity are obtained by variations in stitch type in the base fabric.

9. Sports garment according to claim 6 wherein the variations in the modulus of elasticity are obtained by variations in base fabric weight.

10. Sports garment according to claim 6 comprising at least one base fabric panel which includes at least part of the upper and/or lower compressive zones and at least part of the abdomen-covering portion.

11. Sports garment according to claim 1 wherein the garment is a swimsuit.

12. Sports garment having a lower body-covering portion which, in use, covers at least a part of the wearer's body below the abdomen and an abdomen-covering portion which, in use, covers the wearer's abdomen, wherein the lower body-covering portion includes a lower compressive zone formed of a textile material having a higher modulus of elasticity that the textile forming the abdomen-covering portion, such that, in use, a greater force is applied to at least a part of the wearer's body below the abdomen than the wearer's abdomen, wherein the textile material for forming the lower compressive zone and the textile material for forming the abdomen-covering portion comprise a single layer of the same base fabric having variations in the modulus of elasticity, the lower compressive zone having a lower edge distal from the abdomen-covering portion and an upper edge proximal to the abdomen-covering portion, and wherein there is a gradual increase in the modulus of elasticity in the lower compressive zone from at least one of said edges to an area of maximum compressive effect in the lower compressive zone.

13. Sports garment according to claim 12, wherein the lower body-covering portion is dimensioned and positioned such that it covers and compresses the wearer's thighs.

14. Sports garment according to claim 12, wherein the lower body-covering portion is dimensioned and positioned such that it covers and compresses the wearer's hips.

15. Sports garment according to claim 12, wherein the lower body-covering portion is dimensioned and positioned such that it covers and compresses the wearer's buttocks.

16. Sports garment according to claim 12, wherein the textile material for forming the lower compressive zone and the textile material for forming the abdomen-covering portion comprise the same base fabric having variations in the modulus of elasticity.

17. Sports garment according to claim 16, wherein the variations in the modulus of elasticity are obtained by incorporating varying amounts and/or densities of elastic threads in the base fabric.

18. Sports garment according to claim 16, wherein the variations in the modulus of elasticity are obtained by variations in stitch type in the base fabric.

19. Sports garment according to claim 16, wherein the variations in the modulus of elasticity are obtained by variations in base fabric weight.

20. Sports garment having a chest-covering portion and an abdomen-covering portion which, in use, cover the wearer's chest and abdomen respectively, wherein the chest-covering portion includes an upper compressive zone formed of a textile material having a higher modulus of elasticity than a textile material forming the abdomen-covering portion, such that, in use, a greater compressive force is applied to the wearer's chest than the wearer's abdomen, and wherein the textile material for forming the upper compressive zone and the textile material for forming the abdomen-covering portion comprise a single layer of the same base fabric having variations in the modulus of elasticity, the upper compressive zone having an upper edge distal from the abdomen-covering portion and a lower edge proximal the abdomen-covering portion, and wherein the amount, density, stitch-type and/or weight of the basic fabric gradually varies in the upper compressive zone from at least one of said edges to an area of maximum compressive effect in the upper compressive zone to provide a gradual increase in the modulus of elasticity in the upper compressive zone from the said one edge to the said area of maximum compressive effect.

21. Sports garment according to claim 20, wherein the increase in the amount, density, stich-type and/or weight of the basic fabric from the at least one edge to the area of maximum compressive effect is continuous.

22. Sports garment according to claim 20, wherein the increase in the amount, density, stich-type and/or weight of the basic fabric from the at least one edge to the area of maximum compressive effect is stepped.

23. Sports garment according to claim 20, wherein the at least one edge is the lower edge proximal to the abdomen-covering portion.

24. Sports garment according to claim 20, wherein the variation in the basic fabric varies gradually from both of said edges to said area of maximum compressive effect.

25. Sports garment having a lower body-covering portion which, in use, covers at least a part of the wearer's body below the abdomen and an abdomen-covering portion which, in use, covers the wearer's abdomen, wherein the lower body-covering portion includes a lower compressive zone formed of a textile material having a higher modulus of elasticity that the textile forming the abdomen-covering portion, such that, in use, a greater force is applied to at least a part of the wearer's body below the abdomen than the wearer's abdomen, wherein the textile material for forming the lower compressive zone and the textile material for forming the abdomen-covering portion comprise a single layer of the same base fabric having variations in the modulus of elasticity, and wherein the amount, density, stitch-type and/or weight of the basic fabric gradually varies in the lower compressive zone from at least one of said edges to an area of maximum compressive effect in the lower compressive zone to provide a gradual increase in the modulus of elasticity in the lower compressive zone from the said one edge to the said area of maximum compressive effect.

26. Sports garment according to claim 25, wherein the increase in the amount, density, stich-type and/or weight of the basic fabric from the at least one edge to the area of maximum compressive effect is continuous.

27. Sports garment according to claim 25, wherein the increase in the amount, density, stich-type and/or weight of the basic fabric from the at least one edge to the area of maximum compressive effect is stepped.

28. Sports garment according to claim 25, wherein the at least one edge is the upper edge proximal to the abdomen-covering portion.

* * * * *